United States Patent [19]

Shimazaki et al.

[11] Patent Number: 4,528,936

[45] Date of Patent: Jul. 16, 1985

[54] DEVELOPING APPARATUS

[75] Inventors: Takashi Shimazaki; Niro Nagata, both of Kawasaki, Japan

[73] Assignee: Kabushiki Kaisha Toshiba, Kawasaki, Japan

[21] Appl. No.: 646,161

[22] Filed: Aug. 31, 1984

[30] Foreign Application Priority Data

Aug. 31, 1983 [JP] Japan ..... 58-161249

[51] Int. Cl.[3] ..... G03G 15/06

[52] U.S. Cl. ..... 118/653; 118/651

[58] Field of Search ..... 118/653, 651

[56] References Cited

U.S. PATENT DOCUMENTS 3,232,190 2/1966 Willmott ..... 95/1.7

3,866,574 2/1975 Hardennrook et al. ..... 118/637

4,232,628 11/1980 Shelffo ..... 118/653

*Primary Examiner*—Bernard D. Pianato

*Attorney, Agent, or Firm*—Cushman, Darby & Cushman

[57] ABSTRACT

A developing apparatus is provided with a developing roll for carrying a toner thereon and an elastic blade pressed against the surface of the developing roll to apply the toner thereto. The toner is thus applied to the surface of the developing roll by the elastic blade to form a thin layer of the toner on the surface of the developing roll. The thin layer is opposed to a photosensitive drum at a predetermined space to deposit the toner on an electrostatic latent image in the photosensitive drum. A regulation member is attached to the housing so as to positioned between the housing and the elastic blade. The regulation member has an outlet port of a first width at a central portion thereof. The elastic blade is pressed against the developing roll with a second width greater than the first width.

12 Claims, 6 Drawing Figures

DEVELOPING APPARATUS

BACKGROUND OF THE INVENTION

The present invention relates to a developing apparatus for depositing a developng agent on an image carrier with a latent image thereon, thereby developing the latent image.

Development is achieved, for example, when a developing agent (colored powder called toner) which is charged with a polarity opposite to the electric charges forming an electrostatic latent image is electrostatically attracted to the electrostatic latent image. Developing agents include one-component developing agents which consist of a powdery toner only or a toner coated with $SiO_2$ or another additive, and two-component developing agents which are composed of a powdery toner and a carrier as it is called, such as magnetic powder or fine resin powder, glass, etc. In the two-component developing agents, the toner is securely charged by friction with the carrier. To maintain a constant developing density, on the other hand, the mixture ratio between toner and carrier, i.e., toner density, must be kept constant. Requiring no such control of toner density, the one-component developing agents surpasses the two-component developing agents in easy handling.

The one-component developing agents are classified into two types, magnetic and nonmagnetic. In general, a nonmagnetic developing agent is prepared by mixing resin powder with a color agent such as carbon, while a magnetic developing agent is a mixture of resin powder and magnetic powder.

A prior art method using a one-component developing agent is an application of the so-called no-contact developing process stated in Japanese Patent Publication No. 9475/66. In this developing process, an image carrier is opposed to a layer of a developing agent on a developing agent carrier at a fixed space, and a suitable bias is applied to the developing agent layer to fly the developing agent to image portions of an electrostatic latent image o the image carrier. The no-contact developing process is superior to any other developing methods in the following points. Since a developing agent with electric insulating property or high resistance can be used in the process, there is no possibility of defective transfer. Moreover, the developing agent will not cause fog, since it will not be flown to the no-image portions of the electrostatic latent image. In developing an electrostatic latent image by the no-contact developing process, the distance between the image carrier and the developing agent carrier must be minimized for a visible image of higher quality. Naturally, therefore, the developing agent layer on the developing agent carrier needs to be very thin and uniform.

In order to form such a thin layer of developing agent, a film forming method is disclosed in Japanese Patent Disclosure No. 43037/79 in which a thin layer of a magnetic developing agent is formed on a developing agent carrier containing magnetic field generating means therein. According to this method, a uniformly thin layer of magnetic developing agent can be formed with high reliability. Thus, a satisfactory visible image may be obtained by the use of the no-contact developing process.

The no-contact developing process, however, requires as indispensable requisites a magnetic field generating means, i.e., a magnet, and a magnetic developing agent composed of toner and magnetic powder dispersed therein. Thus, this developing process has the following drawbacks:

(1) the use of the magnet in the developing agent carrier renders the apparatus complicated and expensive, constituting a hindance to the reduction of the size and weight of the apparatus, (2) the magentic developing agent is more expensive than the nonmagnetic one, and (3) containing magnetic powder, the magnetic developing agent is poor in coloring capability and is unsuited for color print.

Thus, the no-contact developing process using the magnetic developing agent has the substantial drawbacks attributed to the use of the magnetic developing agent, as well as many advantages.

Meanwhile, a no-contact developing process using a nonmagnetic developing agent may be considered an ideal developing method which can settle all the problems related to the prior art method. However, this alternative process has one major problem in that the use of the nonmagnetic developing agent makes it difficult to form a uniformly thin layer of the developing agent stably on the developing agent carrier. Therefore, this method has not yet been put to practical use. If the thin layer of the developing agent is not uniform, the amount of the developing agent flown to the electrostatic latent image is rendered partially uneven, preventing the formation of a good-quality visible image (image formed by flying the developing agent to an electrostatic latent image).

In order to form a thin layer of the nonmagnetic developing agent, an elastic blade is pressed against the surface of the developing agent carrier. The elastic blade is elastically and partially deformable by the flow of a developing agent or the like. In a developing apparatus in which a developing agent is uniformly coated on the entire surface of a developing agent carrier, a pressure distribution of the developing agent on a surface of a developing roller increases at two end portions of the developing agent carrier. Therefore, the elastic blade is partially deformed by such a developing agent under pressure, thereby forming a gap between the developing agent carrier and the elastic blade. In this case, the developing agent can leak and drop from the two end portions of the developing agent carrier through this gap. This tendency is particularly notable in the case wherein a non-magnetic developing agent is used, resulting in the contamination of the interior of a copying machine or the like.

SUMMARY OF THE INVENTION

The present invention has been made in consideration of the above situation, and has as its object to provide a developing apparatus wherein leakage and dropping of a developing agent from the two end portions of a developing agent carrier is prevented, and the contamination of the interior of a copying machine or the like is eliminated.

In order to achieve the above object, a developing apparatus according to one aspect of the present invention comprises a housing for storing a developing agent therein and having an outlet port of a first width, said developing agent flowing from inside of said housing through said outlet port, a developing agent carrier for carrying said developing agent flowing from said outlet port and feeding said developing agent, and an elastic member, pressed against the surface of the developing agent carrier with a second width greater than the first width, to apply the developing agent thereto, so that the developing agent is applied to the surface of the developing agent carrier by the elastic member to form a layer on the surface of the developing agent carrier, and that the layer is opposed to an image bearing member at a predetermined space to deposit the developing agent on a latent image on the image bearing member.

DETAILED DESCRIPTION OF THE PREFERRED EMBODIMENTS

One embodiment of a developing apparatus according to the present invention applied to an image forming apparatus will now be described in detail with reference to the accompanying drawings of FIGS. 1 to 6.

Figure 1:
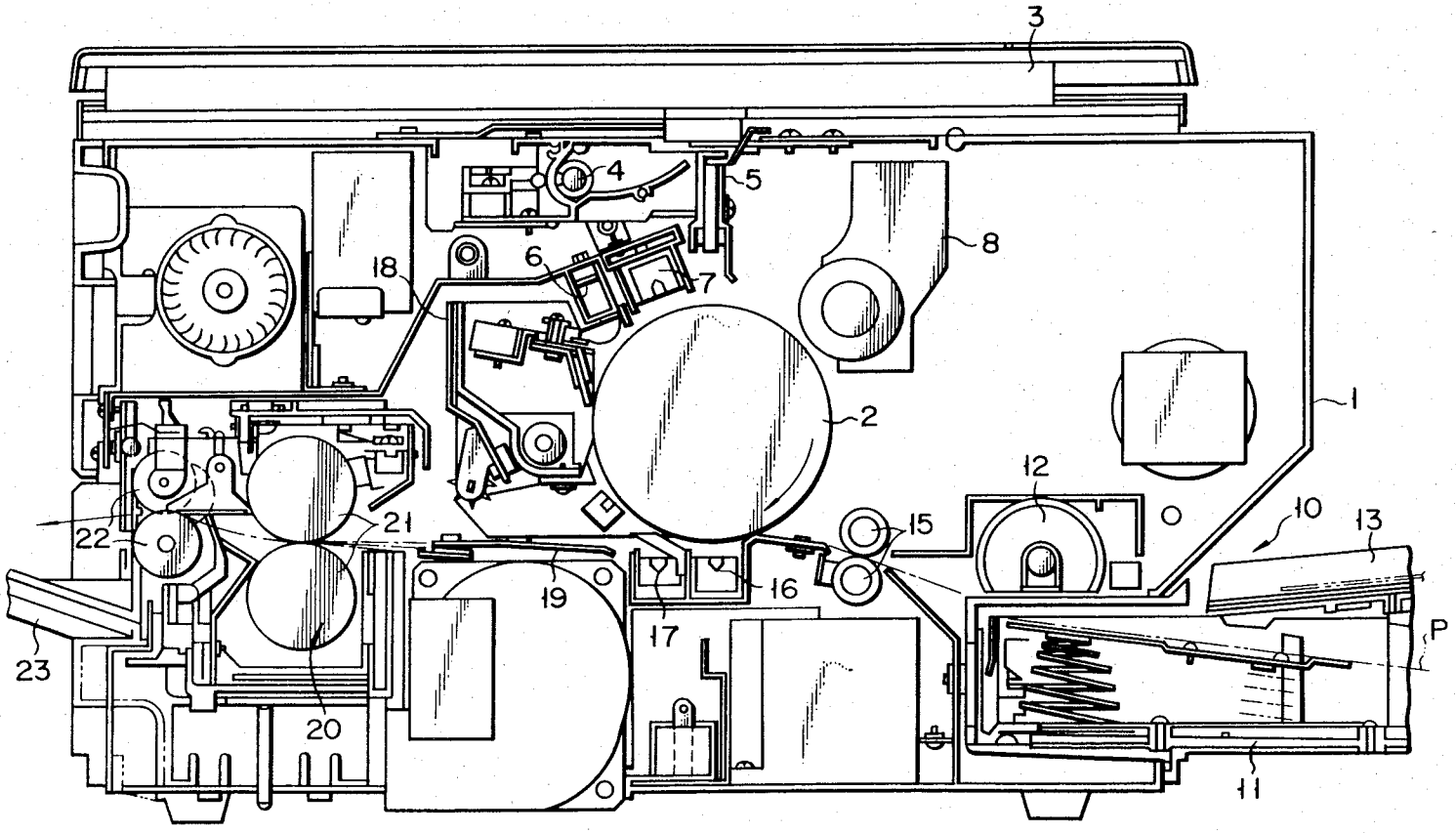
FIG. 1 is a sectional view schematically showing a copying machine using a developing apparatus according to the present invention.

First, the image forming apparatus, e.g., a copying machine, using the developing apparatus of the invention will be described. FIG. 1 is a sectional view schematically showing the copying machine. In FIG. 1, numeral 1 designates a housing of the copying machine. Rotatably disposed in the central portion of the housing 1 is an image carrier, e.g., a photoconductive drum 2 made of selenium, on the surface of which is formed an electrostatic latent image. The photoconductive drum 2 is surrounded by a lamp 4 and a convergent light transmitting member 5 for optically scanning an original paper put on a horizontally reciprocating original table 3 and for forming an electrostatic latent image corresponding to an image of the original paper on the surface of the photoconductive drum 2, a discharge lamp 6 for de-electrifying the surface of the photoconductive drum 2 before the formation of the original image, a charger 7 for uniformly charging the surface of the photoconductive drum 2 after the de-electrification, and a developing apparatus 8 according to the invention for selectively flying a developing agent to the electrostatic latent image on the surface of the photoconductive drum 2 to develop the electrostatic latent image. Thus, the developing apparatus 8 forms a visible image on the surface of the photoconductive drum 2.

A paper feeding section 10 is provided at one side portion (right-hand side portion of FIG. 1) of the housing 1. The paper feeding section 10 includes a paper cassette 11 removably attached to the one side portion of the housing 1, a paper supply roller 12 in rolling contact with the uppermost one of sheets P contained in the paper cassette 11 and capable of delivering the sheets P one by one into the housing 1, and a sheet-bypass guide 13 for manual paper supply. Each sheet P delivered from the paper feeding section 10 is regulated for feed timing by a pair of aligning rollers 15, and fed so as to be in rolling contact with the photoconductive drum 2 in a transfer section.

The photoconductive drum 2 is also surrounded by a pre-transfer charger 9, a transfer charger 16 for transferring the developing agent to the sheet to form a visible image thereon, and a separation charger 17 for separating the sheet from the photoconductive drum 2 after transfer. The transfer section is defined between the photoconductive drum 2 and the transfer charger 16. After the developing agent image (visible image) is transferred to the sheet, the sheet is guided to a fixing unit 20 by a conveyor belt 19. The developing agent is fixed by the pressure and heat of a pair of heat rollers 21 which constitute the fixing unit 20. After the fixation, the sheet is discharged onto a tray 23 by a pair of exit rollers 22. After the transfer operation, the developing agent remaining on the surface of the photoconductive drum 2 is removed by a cleaning unit 18.

Figure 2:
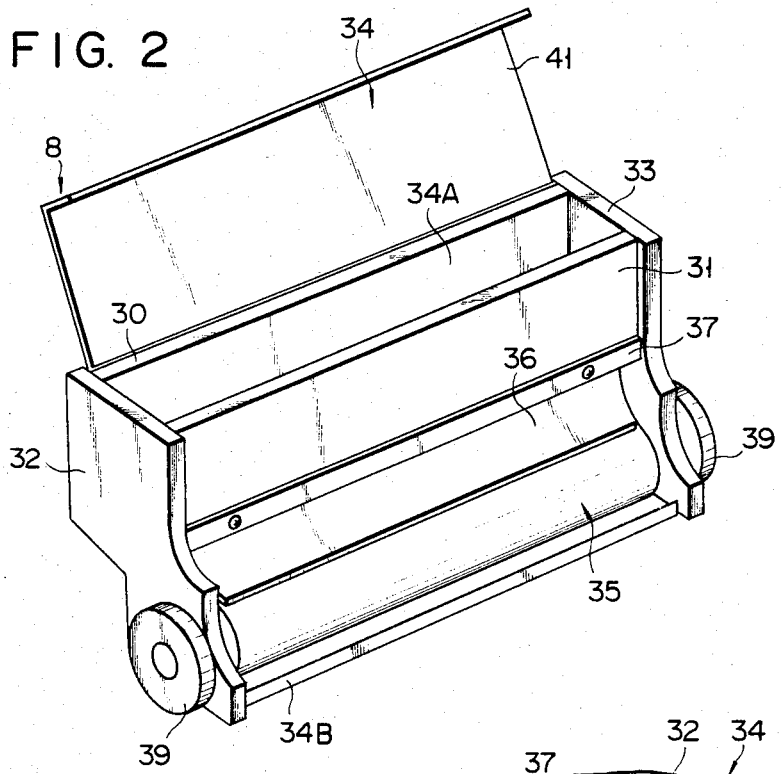
FIG. 2 is a perspective view schematically showing a developing apparatus according to one embodiment of the present invention.
Figure 3:
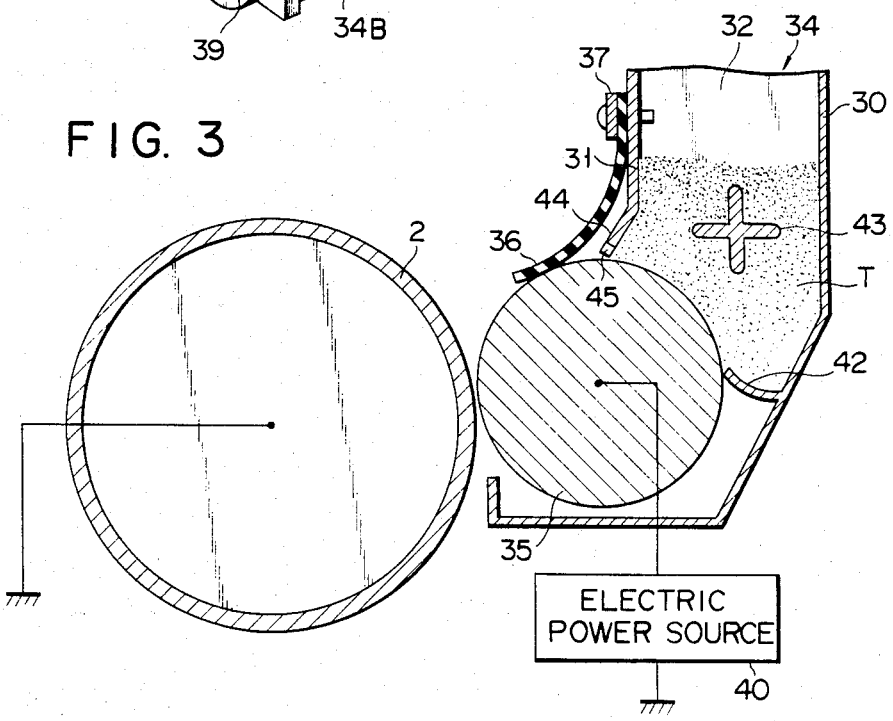
FIG. 3 is a sectional view schematically showing the developing apparatus of FIG. 2.

The developing apparatus 8 according to the first embodiment of the invention will be described in detail. FIGS. 2 and 3 are a perspective view and a sectional view, respectively, schematically showing the developing apparatus 8.

The developing apparatus 8 has a housing 34 which contains a nonmagnetic developing agent. The housing 34 is provided with a back frame 30 and a front frame 31 spaced from each other and side frames 32 and 33 attached to both side portions of the frames 30 and 31. The housing 34 is open at both the top and bottom and has a swingable cover member 41 at its top opening 34A. When the cover 41 is up, the developing agent is supplied through the top opening 34A. Disposed near a bottom opening 34B of the housing 34 is a rotatable developing agent carrier, e.g., an aluminum or stainless-steel developing roller 35, which carries the developing agent on its surface. The developing roller 35 is pivotally mounted on the two side frames 32 and 33.

A recovery blade 42 is arranged on the inner surface of the back frame 30. In the housing 34 of the developing apparatus, a stirrer 43 is pivotally arranged to stir the developing agent T. Furthermore, the leading end portion of the front frame 31 extends to a position near the developing roller 35 and serves as a developing agent regulating member 44, as will be described later.

The front frame 31 is fitted with an elastic blade 36 by means of a blade holder 37. The elastic blade 36 is formed of, e.g., silicone-butadiene rubber (40 to 90 hardness), urethane rubber, stainless steel, phosphor bronze (approximately 0.01 to 0.5 mm in thickness), or urethane sheet. The elastic blade 36 is pressed against the surface of the developing roller 35 to coat the surface with the developing agent T. The contact pressure between the elastic blade 36 and the developing roller 35 can be finely adjusted by controlling the position of the blade holder 37.

Part of the surface of the elastic blade 36 opposed to the developing roller 35 is in surface contact with the developing roller 35. Therefore, the contact area between the elastic blade 36 and the developing roller 35 is wider than in the case of the prior art construction in which the free end portion of the elastic blade is pressed against the developing roller. Thus, the fine adjustment of the contact pressure on the developing roller 35 is easy, and the contact pressure can be made uniform. Also, the developing agent can enjoy friction under the contact pressure for a longer time, thus acquiring uniform and sufficient electric charges.

The developing apparatus 8 is located in a position such that the developing agent layer on the developing roller 35 is not in contact with the photoconductive drum 2. A gap G between the developing roller 35 and the photoconductive drum 2 depends on the particle size of the developing agent and the thickness of the developing agent layer. To ensure the flight of the developing agent for a visible image of good quality, it is necessary to minimize the gap G. The gap G can be narrowed only if the developing agent layer on the developing roller 35 is a thin layer. The range of the particle size of the developing agent used depends on the resolution of the desired image. Thus, the practical gap G between the developing roller 35 and the photoconductive drum 2 ranges from approximately 50 to 400 microns. Here the thin layer may be a monolayer or a multilayer, including up to six or seven layers, of the developing agent.

To maintain the accuracy of the gap G, a pair of gap control rollers 39 are mounted on the shaft of the developing roller 35 so as to be rotatable in a body. The gap control rollers 39 come into contact with both side portions of the peripheral surface of the photoconductive drum 2 or engaging rollers (not shown) mounted on the shaft of the photoconductive drum 2, thereby keeping the intercentral distance between the photoconductive drum 2 and the developing roller 35. A power source 40 is provided for applying a voltage to the developing roller 35 to form an electric field between the photoconductive drum 2 and the developing roller 35 and generally includes D.C. power source or deviated A.C. power source. The power source 40, which is not requisite for the developing apparatus 8 of the invention, serves to facilitate the flight of the developing agent on the developing roller 35 to the surface of the photoconductive drum 2 by forming the electric field between the two members 2 and 35. The developing agent frictionally charged on the developing roller 35 is transferred to the surface of the photoconductive drum 2 by only an electrostatic attraction attributed to latent image charges on the surface of the photoconductive drum 2.

The developing roller 35, the elastic blade 36 and the developing agent regulating member 44 will now be described in detail with reference to FIG. 4.

Figure 4:
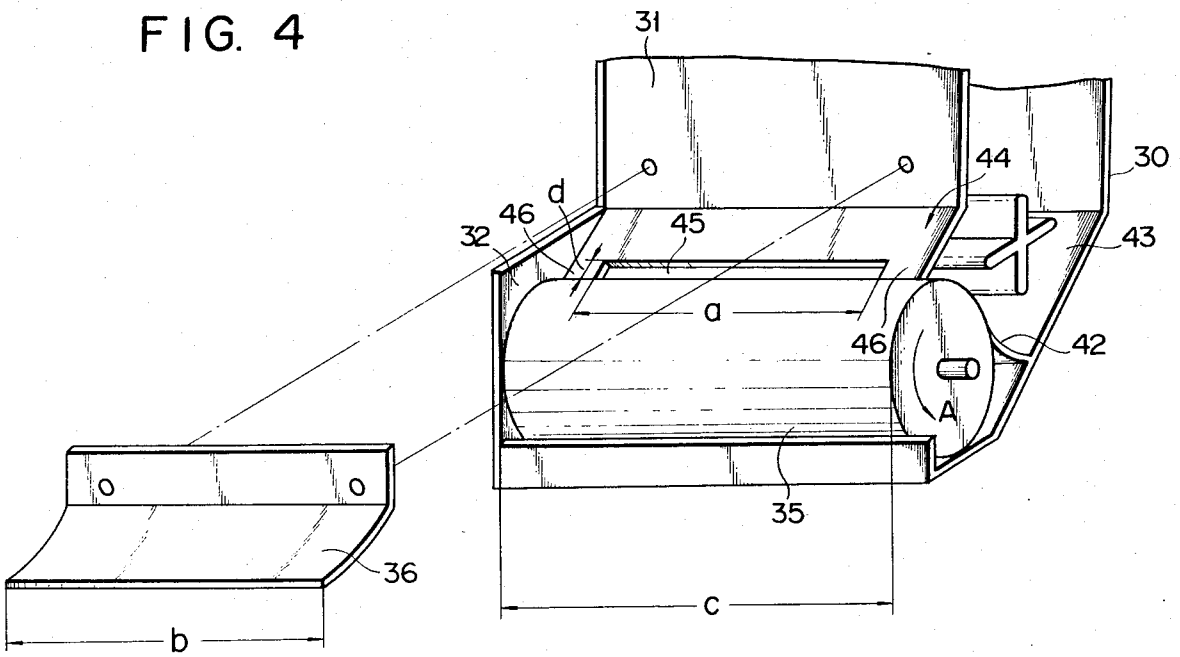
FIG. 4 is a exploded perspective view showing the developing apparatus of FIG. 2.

FIG. 4 is an exploded perspective view showing the developing apparatus. The developing agent regulating member 44 is constructed by a lower end portion of the front frame 31 which extends to a position near the developing roller 35. A lower portion of the developing agent regulating member 44 corresponding to a central portion of the developing roller 35 has a developing agent outlet port 45 having a depth d and a width a. The depth d is defined such that the developing agent T in the housing 34 can flow smoothly. In addition, the width a is defined to correspond to a developing region. If the depth d is small, the flowability of the developing agent T is impaired. If the depth d is large, the developing agent regulating member 44 cannot serve its purpose.

The flowability of the developing agent T depends upon components thereof. A one-component developing agent can consist of, for example, toner particles composed of an acrylic, epoxy, styrene resin or the like, or such toner particles on which an additive such as carbon, silica ($SiO_2$) or the like is applied. When the depth d is determined, an average diameter of the developing agent particle T must be considered. The average diameter of the developing agent particle T is about 10 μm. It is experimentally confirmed that the depth d is preferably set to be 2 mm or less.

A pair of projections 46 are formed at two side end portions of the developing agent regulation member 44 and define two side ends of a developing agent outlet port 45. The projections 46 are slightly spaced apart from the surface of the developing roller 35. The projections 46 prevent the leakage of the developing agent T in the housing 34 from the two end portions of the developing roller 35.

If a width of the elastic blade 36 is given by b, the width a of the developing agent outlet port 45 is smaller than the width b. Furthermore, if a width of the devolopment roller 35 is given by c the width b of the elastic blade 36 is smaller than the width c.

Operation of the developing apparatus 8 having the above-metioned construction will now be described.

In the developing apparatus 8 storing the developing agent T in the housing 34, the developing roller 35 is rotated along a direction indicated by an arrow A in FIG. 4. The developing agent T is fed under the elastic blade 36 through the developing agent regulation member 44 by a feeding force generated by the rotation of the developing roller 35 or the like. The thus fed developing agent T is charged by friction with the elastic blade 36. In this case, a flow path of the developing agent T fed by the feeding force of the developing roller 35 is regulated before it reaches the elastic blade 36. In other words, the flow of developing agent T, which flows against the projections 46 positioned at both sides of the developing agent outlet port 45, is prevented. Therefore, the developing agent T flows within the width a of the developing agent outlet port 45. The developing agent T fed under the elastic blade 36 is substantially regulated to flow within the width a or has a slightly larger flow width than width a. The developing agent T is fed under the elastic blade 36 in this manner and is uniformly coated to form a thin layer on the developing roller 35 by a pressing force of the elastic blade 36.

The width b of the elastic blade 36 is wider than the width a of the developing agent outlet port 45. For this reason, the developing agent T fed through the outlet port 45 can be charged and coated on the developing roller 35 without leakage. On the other hand, the width b of the elastic blade 36 is set to be narrower than the width c of the developing roller 35. Therefore, even if the developing agent T is fed to an area exceeding the width b, this leaked developing agent T can be applied at least on the developing roller 35. Thus, the developing agent T will not leak or drop from the two end portions of the developing roller 35.

The developing agent T which is not pressed by elastic blade 36 can be charged by mutual contact due to the stirring operation of the stirrer 43 and can be applied on the developing roller 35. Furthermore, if the two end portions of the developing roller 35 on which the leaked developing agent T is attached correspond to a non-exposed portion, the developing agent T attached to the non-exposed portion can be recovered through the photoconductive drum 2. In this manner, since the flow path of the developing agent T is regulated and the developing agent T is applied at least on the developing roller 35, the developing agent T will not leak or drop from the two end portions of the developing roller 35, thereby preventing the contamination of the interior of the machine.

The present invention is not limited to the embodiment described above and various modification are deemed to lie within the spirit and scope of the present invention. For example, the developing agent regulating member 44 need not always be formed integrally with the front frame 31, and it can be formed as a separate member with respect to the front frame 31. A construction in which the depth d can be finely-adjusted can also be adopted. The projections which define two side ends of the developing agent outlet port 45 can be formed of a member having a low friction coefficient such as felt, urethane, or silicone rubber and can be arranged to be pressed against the surface of the developing roller 35. In this manner, fine adjustment of gap between the projections 46 and the developing roller 35 is not required, thereby satisfactorily and easily regulating the flow path of the developing agent T.

Figure 5:
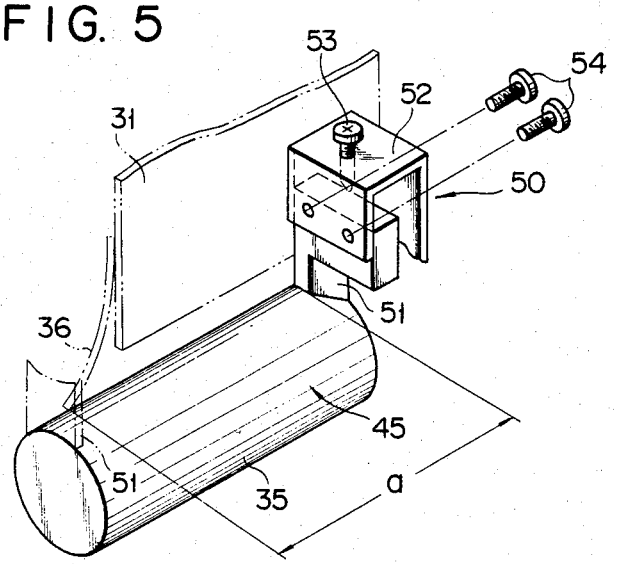
FIG. 5 is a perspective view schematically showing a developing agent restricting member of one modification according to the embodiment.

Furthermore, the developing agent regulation member can be modified as shown in FIG. 5 as a means for regulating the flow path of the developing agent T. FIG. 5 is a perspective view schematically showing a developing agent regulating member according to one modification.

A developing agent regulating member 50 shown in FIG. 5 consists of wall members 51 having inclined surfaces whose two end portions for defining the two side portions of the developing agent outlet port 45 are inclined along a direction perpendicular to a feeding direction of the developing agent T. The developing agent T abuts against the inclined surfaces of the wall members 51, and the flow path thereof is regulated to fall within the width a. Contact portions of the wall members 51 with the developing roller 35 are formed of, e.g., felt, urethane, silicone rubber or the like. The wall members 51 are vertically movable along fixing members 52 fixed by frames (not shown). Up and down positions of the wall members 51 can be adjusted by adjusting screws 53 and can be fixed to the fixing members 52 at a desired position by fixing screws 54.

By constructing the developing agent regulating member 50 as described above, a feeding direction of the developing agent T fed along the two end portions of the developing roller 35 is regulated at the two end portions toward a central portion of the developing roller 35. In addition, the developing agent outlet port 45 is formed to have the width a with respect to the elastic blade 36.

Figure 6:
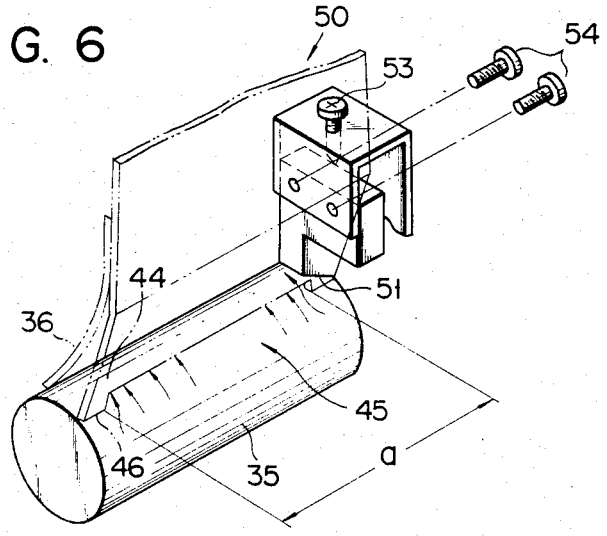
FIG. 6 is a perspective view schematically showing a developing agent restricting member of the other modification according to the embodiment.

FIG. 6 shows another modification of the developing agent regulation member. As shown in FIG. 6, the developing agent regulation member 50 can be arranged in addition to the developing agent regulation member 44 having the projections 46 between the member 44 and the elastic blade 36.

In this construction, even if the developing agent T first regulated to the width a by the developing agent regulation member 44 is spreaded toward the two end portions of the developing agent outlet port 45, the spread developing agent T can be regulated again to the width a by the developing agent regulating member 50. Therefore, leakage and dropping of the developing agent T from the two end portions of the developing roller 35 can be completely prevented.

As described above, according to the present invention, when a one-component developing agent is used, a developing apparatus which can prevent leakage and dropping of a developing agent from the two end portions of a developing agent carrier can be provided.

What is claimed is:

1. A developing apparatus comprising:

a housing for storing a developing agent therein and having an outlet port of a first width, said developing agent flowing from inside of said housing through said outlet port;

a developing agent carrier for carrying said developing agent flowing from said outlet port and feeding said developing agent; and an elastic member, pressed against the surface of the developing agent carrier with a second width greater than the first width, to apply the developing agent thereto, so that the developing agent is applied to the surface of the developing agent carrier by the elastic member to form a layer on the surface of the developing agent carrier, and that the layer is opposed to an image bearing member at a predetermied space to deposit the developing agent on a latent image on the image bearing member.

2. An apparatus according to claim 1, wherein said housing has an inner width substantially equal to the second width of said developing agent carrier and a portion of said developing agent carrier is positioned in said housing.

3. An apparatus according to claim 2, wherein said housing includes a regulating member arranged at an upstream side of said elastic member along a feeding direction of said developing agent by said developing agent carrier, wherein said regulating member has said outlet port at a portion opposing said developing agent carrier.

4. An apparatus according to claim 3, wherein said housing has a front wall, said elastic member is fixed to said front wall and said regulating member is formed at a lower portion of said front wall.

5. An apparatus according to claim 3, wherein said regulating member includes, an opening formed at a substantially central portion thereof to define said outlet port; and projections, formed at two side portions of said opening, for substantially preventing a flow of said developing agent.

6. An apparatus according to claim 5, wherein leading ends of said projections have rigidity and are slightly spaced apart from a surface of said developing agent carrier.

7. An apparatus according to claim 5, wherein leading ends of said projections have a low friction coefficient and are in contact with a surface of said developing agent carrier.

8. An apparatus according to claim 1, wherein said developing agent carrier has a width larger than that of said elastic member.

9. An apparatus according to claim 8, wherein said developing agent carrier has non-contact portions, which are not pressed against said elastic member, at two side portions thereof.

10. An apparatus according to claim 9, wherein said non-contact portions correspond to non-developing portions.

11. An apparatus according to claim 5, wherein said projections extend along a direction substantially perpendicular to the feeding direction of said developing agent.

12. An apparatus according to claim 5, wherein said projections obliquely extend along a direction perpendicular to the feeding direction of said developing agent carrier and regulate said developing agent toward a central portion of said developing agent carrier.

* * * * *